United States Patent [19]

Roepke

[11] 4,251,109

[45] Feb. 17, 1981

[54] DUST CONTROLLING METHOD USING A COAL CUTTER BIT

[75] Inventor: Wallace W. Roepke, Excelsior, Minn.

[73] Assignee: The United States of America as represented by the Secretary of the Interior, Washington, D.C.

[21] Appl. No.: 81,506

[22] Filed: Oct. 3, 1979

[51] Int. Cl.[3] ..... E21C 7/10

[52] U.S. Cl. ..... 299/12; 299/81; 299/86; 299/17

[58] Field of Search ..... 299/12, 81, 17, 86, 299/91; 175/65; 239/101

[56] References Cited

U.S. PATENT DOCUMENTS

| | | | |
|---|---|---|---|
| 3,203,736 | 8/1965 | Andersen | 299/17 |
| 3,374,033 | 3/1968 | Arentzen | 299/81 |
| 3,544,166 | 12/1970 | Proctor | 299/91 |
| 3,729,137 | 4/1973 | Cobb | 299/17 |
| 4,025,116 | 5/1977 | Roepke | 299/81 |

*Primary Examiner*—William F. Pate, III

*Attorney, Agent, or Firm*—Thomas Zack; Donald A. Gardiner

[57] ABSTRACT

A method of augmenting the cutting operation of a cutter bit to reduce the cutting energy required and to reduce the respirable dust generated during the cutting operation. During the cutting operation of coal with a continuous mining machine greater than 90 percent of the primary respirable dust generated occurs in the crushing zone around the tip of bit. By applying a high pressure (2,500 to 5,000 psi) spray of water at or near the center of the cutting tip, as the tip touches the coal, tests have shown very substantial reductions in the airborne respirable dust generated and that there is lubrication and cooling at the cutter tip/mineral interface to provide for reduced sumping forces and lowered methane ignition potential.

6 Claims, 6 Drawing Figures

27
33
31
35
29
25

27
35
33
31
29
25

37
39
23
31
29
25
3
5
9

37
39
35
A
A
27
31
29
33
B
B
25

DUST CONTROLLING METHOD USING A COAL CUTTER BIT

BACKGROUND OF THE INVENTION

1. Field of the Invention

A method of augmenting the cutting operation of a continuous mining machine by the optimum placement of high pressure water jets.

2. Description of the Prior Art

Two sources of patent literature provide what is believed to be the closest prior art. These are the two U.S. Pat. Nos. 3,272,940 (P. Belugou) and 4,025,116 (Roepke et al). In the former reference water is delivered and discharged . . . "to the rear of the cutting edge of the picks in the zone in which the dust is concentrated." (column 2, lines 8–11). The W. W. Roepke et al patent is really not concerned with the reduction of airborne respirable dust by the use of water jets but, it does disclose (see column 3, lines 51–65) the use of high pressure (10,000 psi or more) water jets located at the center line of the bits' points to precut holes or slots in the coal face.

Neither of these references disclose the same or a similar apparatus and/or method as that now being claimed whose main purposes are to reduce primary respirable dust generation, to reduce the energy required in the cutting operation; and to lower methane ignition potential from frictional heating. The invention to Belugou is concerned with reducing dust and cooling the cutting head but the water discharge outlet is not at or near the bit's cutting area or the need to control water volume. Additionally Belligou does not discuss the water pressures needed. The W. W. Roepke at al patent is concerned—as far as the high pressure water spray—with only kerf cutting clearance for the carbide bit tip, not with reducing dust or cooling the cutting bits. If the 10,000 or more psi cutting pressure were used, the coal would be cut in such a manner as to substantially increase total water volume at the face leading to potential soft bottom problems. This invention seeks to place the water around the tip of the bit with sufficient pressure to keep the nozzle opened during the cutting operation by using a pressure equal to or slightly less than the compressive strength of the coal being cut (less than 6,000 psi) in such a manner as will minimize water at the face area thus preventing soft bottom problems. This approach will make this invention amenable to a larger number of mines.

SUMMARY OF THE INVENTION

This invention is a method of controlling dust at a coal cutter bit by the use of water. The water is discharged at or near the cutting edge of the bit at a pressure between the range of 2,000 to 6,000 psi. When the bit is on a continuous mining machine, such as a drum type cutter, the water flow will be controlled so that it begins shortly before the start of cutting by each individual bit and ends after the cutting is completed by the same bit.

The primary object of this invention is an improved method of controlling dust generated by a cutter bit with the use of a properly placed high pressure water spray.

DESCRIPTION OF THE PREFERRED EMBODIMENT

Figure 1:
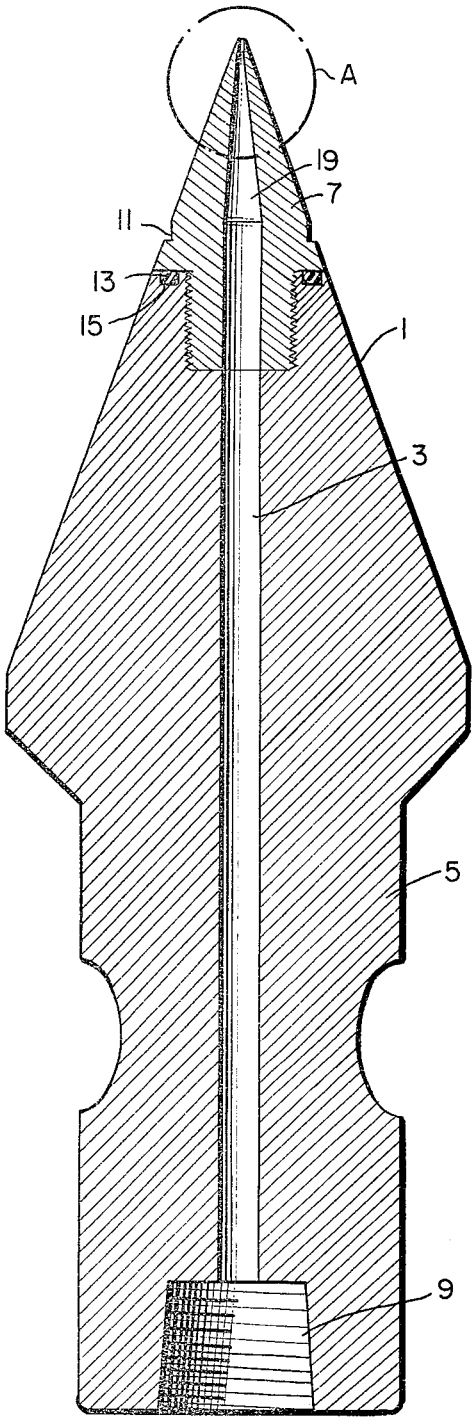
FIG. 1 is a typical conical cutter bit which incorporates the preferred embodiment of the apparatus useable in practicing this invention.

A full understanding of the impact of this invention can only be had after knowing its background. For many years control of primary dust generation during coal cutting operations with automated equipment has been attempted by the use of water sprays mounted on the boom or near the cutting bits. Unfortunately these techniques do nothing to lessen the generation per se of the respirable dust. These techniques currently being used only attempt to suppress the dust after it has been generated in the cutting operation and is already airborne. The first known patent reference which was concerned with reducing the primary generation of respirable coal dust during the cutting operation to prevent it (the dust) becoming airborne by the fanning action of the continuous mining machine is the U.S. Pat. No. 4,025,116 of which I am a co-inventor. The contents of this patent are specifically incorporated as background reference material especially as it relates to tests relating to the depth of cut and the amount of generated airborne respirable dust. Most of the coal cutting continuous mining machines presently in use in the United States are of the rotating shallow type of cutters which penetrate no more than one inch into the coal mine face and as a consequence produce excessive quantities of airborne respirable dust. Although the practices of the invention disclosed in this patent and the related United States improvement patents numbered U.S. Pat. No. 4,012,077 and U.S. Pat. No. 4,062,595 would reduce the generation of airborne respirable dust, they would require substantial major modifications to existing machines. For economic and practical—but not technical—reasons it is desireable to provide suitable dust control techniques for existing drum type mining machines. This invention realizing these obstacles allows one to either modify the three mentioned background patents or to take currently used water suppression methods and modify them to produce optimum dust control at the bit's cutting tip/mineral interface on existing mining machines.

Essentially it must be recognized that tests have shown currently used shallow cutters on continuous mining machines generate greater than 90 percent of the primary respirable dust in the first ⅛ inch depth of cut. The tip area of the bits creates the major primary respirable dust by crushing the product being mined. Further tests have confirmed that water can prevent respirable dust from becoming airborne, but not cut down on this generation. The optimum water placement would be directly in the center of the crushing zone. This will prevent airborne dispersal of the respirable dust and, will lubricate the cutter tip reducing friction and heating at the bit tip/mineral interface. The volume of water dispersed near the tip should be kept low to prevent soft bottom from excessive water in the face area. To do this the orifice's discharge should be within ⅛ of an inch from the tip's cutting area and have a small diameter. Clogging of this orifice by broken coal or other debris is prevented by using high pressure water. The exact water pressure will be determined primarily by the compressive strength of the material being cut. The pressure should be equal to, or slightly less than the compressive strength of the coal being cut. For most coal this would be below 5,000 psi. Tests conducted on coal with water pressures between 2,500 to 5,000 psi have been very satisfactory. If hard inclusions such as pyrites, shale bands, etc. are to be cut it is anticipated that higher pressures may be needed.

Assuming a water pressure of 5,000 psi and an orifice cross section of 0.010 inch, then 0.2 gallons per minute (gpm) of water will be dispersed for each bit. At that rate a drum-type rotary bead machine with 52 cutting bits would use 10.4 gpm which would leave another 10 to 14 gpm for the boom sprays on the gathering head area. The actual configuration of the plumbing that would be used to bring the water to the drum head and then to the cutting bit is not part of this invention. Preferably there would be a cyclic control to turn on or permit passage of the high pressure water within 5 degrees to each cutter bit entering the coal and to turn off the water within 5 degrees after each bit leaves the coal. This technique is described in the U.S. Patent to Arentzen (U.S. Pat. No. 3,374,033). Should it be desired to rotate the bit to optimize its life, a water swivel connection such as that used in U.S. Pat. No. 3,210,099 could be used. With this connection each cutting bit would rotate about its own longitudinal axis as the cutting operation takes place.

The modification of the Linear Cutting Rotary Head for a Continuous Mining Machine by Roepke et al (U.S. Pat. No. 4,012,077) would probably be the optimum design into which to incorporate the principles of this invention. This would provide for the deep cuts (at least three inches) by a bit advance from rotary action of the cutting head with widely and optimally spaced bits, as set forth in that patent, with the resultant reduction of airborne respirable dust. With this invention incorporated therein the small amount of dust generated would be further reduced at the source before dispersal by ventilation air and the cutting action will be further enhanced. The machine size and power requirements will also be lowered since less reactive energy will be required to hold the cutting head in the coal face during cutting.

The FIG. 1 preferred embodiment illustrates a cross-sectional view of the proposed cutter bit design. A standard conical point plumb-bob design was selected for the outer configuration of bit 1 but it should be obvious to anyone skilled in the art than any conical cutter is adaptable. A hollow uniform diameter bore 3 for the passage of water runs through the axial center of the shank 5 portion of the bit until it joins a reduced section in the tip 7. The shank, which may be of many shapes, also contains the continuation of the bore 3. At the bottom end of the shank is a female fitting 9, to receive the hose and a water swivel, if used. Normally the tip would be custom designed and made to permit changes in orifice diameters, higher or lower pressure jets, increased water flow rates, and/or the repair of broken tips. A spanner wrench placed over the tip engages the circumferentially located slots 11 and functions to allow the unseating of the tip. The crushed metal or elastomer O ring 13 is changed with the tip and rides in the O-ring groove 15 of the uppermost shank section. The threads 17 on the extending tip portion between the tip and upper recessed portion of the shank serve to provide a tight fit therebetween when they interfit with the complementary shank threads.

Figure 2:
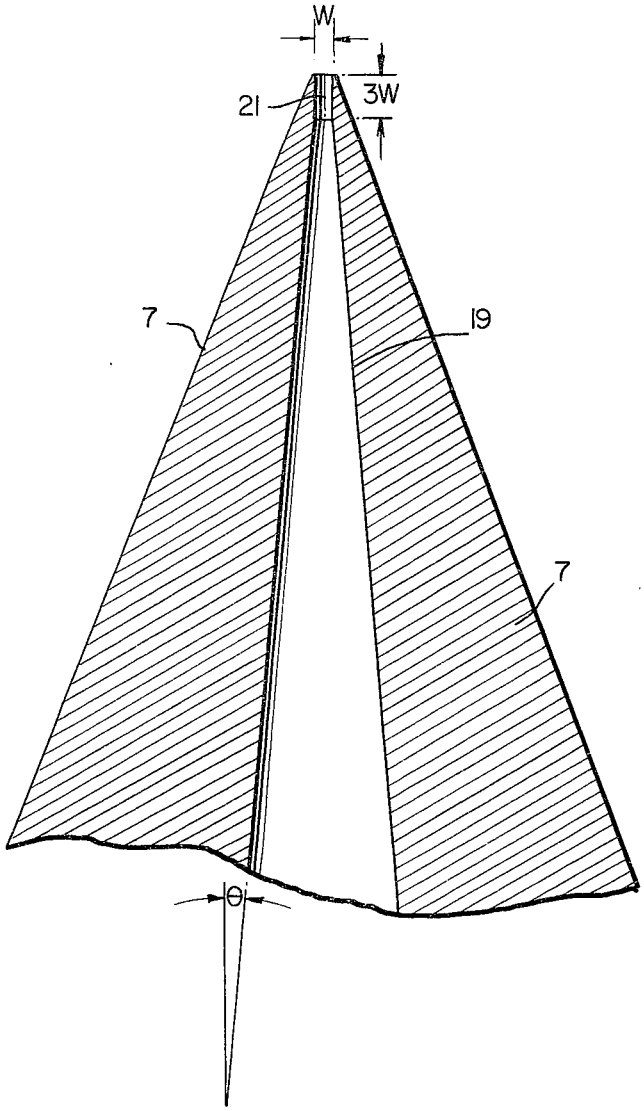
FIG. 2 is a enlarged view of the encircled part of FIG. 1, designated with A, cutter bit tip.

FIG. 2 is an enlarged view of the tip area enclosed within the circle A of FIG. 1. The upper section of the bore is formed by reduced diameter tapered section 19 which goes to the water discharge orifice by forming an angle $\phi$ with the uniform diameter vertical section of bore 3. This angle would normally be about 6½ degrees. After narrowing down from the large uniform diameter of conduit 3, the conduit again becomes uniform in cross-sectional diameter at the smaller forward bore discharge section 21. For the example given of 5,000 psi. and a discharge rate of 0.2 gpm the orifice diameter of section 21 should be 0.010 inches. If W represents this width at the discharge end then the length of the vertical section immediately before the slope ends (i.e. at the section 21) would be 3 W or 0.030 inch. The United States Bureau of Mines Report of Investigations (RI) numbered 5915 published in 1961 entitled "Hydraulic Coal Mining Research: Equipment and Preliminary Tests" by J. J. Wallace, G. C. Price and M. J. Ackerman describes many of the factors to be considered in the design of a nozzle tip.

Figure 3:
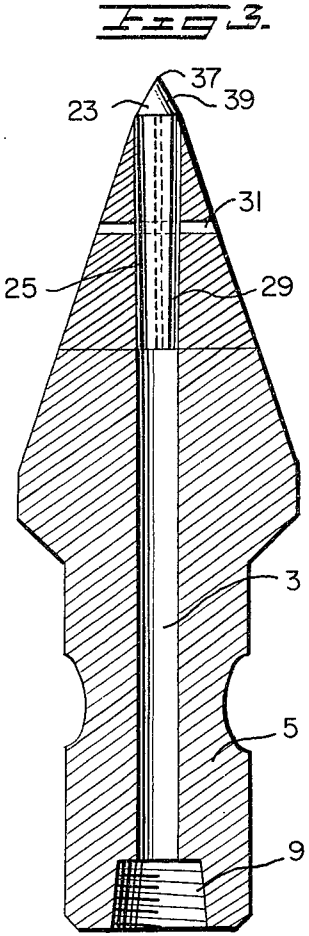
FIG. 3 illustrates a cross sectional view of an alternate less preferred embodiment of this invention in which a plurality of water discharge orifices are provided around and near the bit tip's cutting edge.

FIG. 3 depicts in cross-sectional view, an alternate embodiment of the invention shown in FIGS. 1–2.

Figure 5A:
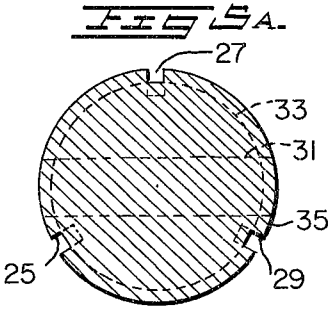
FIG. 5(*a*) and 5(*b*) are cross sectional views of the FIG. 4 tip along lines A—A and B—B, respectively.
Figure 5B:
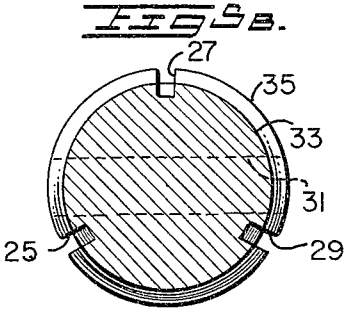
Figure 4:
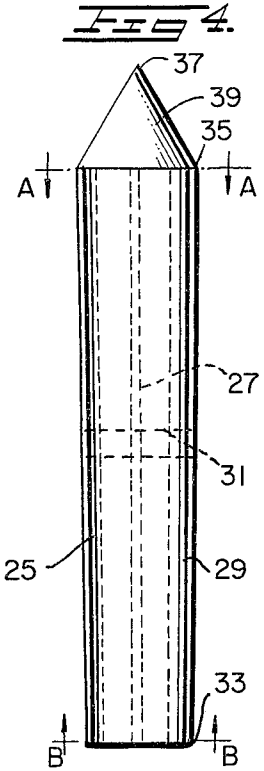
FIG. 4 is an enlarged view of the tip used in the FIG. 3 embodiment.

The shank body of FIG. 3 is the same as the body 5 of FIG. 1, as are all parts bearing the same numbers. The difference between these two embodiments resides in the tip 23 shown in enlarged detail in FIG. 4. This tip is a standard self-locking tapered carbide tip which is replaceable that has been modified by the addition of the three elongated water slots or grooves designated by the numbers 25, 27, and 29. When properly seated in the bit body 5 a pin (not shown) can be used to secure the bit body to the carbide tip by inserting the pin in the tip/upper body through aperture 31. The cross-sectional view (FIG. 5(*a*) taken along line A—A of FIG. 4 depicts how the three exit orifices for their respective slots would appear when viewed from above. FIG. 5(*b*) shows these same slots as viewed along line B—B (FIG. 4) looking upwardly. Since the tip is tapered inwardly along its length, when viewed from above, its upper diameter 35 is larger across at its greatest extent than the lower tip diameter 33. (See FIGS. 4 and 5(*a*),-5(*b*). The upper volume 39 of the tip is cone shaped and terminates at its apex 37. FIG. 3 shows to scale that the height of this volume is small as compared to the total length of the tip. As water is forced through bore hole 3 it first encounters the three tip grooves through which it passes until it exits at the three exits around the lower side of volume 39.

Besides the point of attack type, other types of bit shapes could be used for the shank portion. These would include the wedge cutters, chisel bits, etc. with the water passage being through the mounting shank of any cross section suitable for the forces involved. Those configurations using a rectangular or square mounting shank would not require a water swivel connection since they are not designed to rotate about their mounting. Either lubricating and/or dust reduction additives may be used in the water sprayed. Generally the additives for dust reduction have to be carefully chosen for the coal being cut to achieve the maximum benefit from the additive.

The basic purpose of this invention is to put water at sufficient pressure to keep the nozzle open into the crushing zone at a location approximately ⅛ inch diameter around the cutting tip of the bit. Various tests conducted on this point confirm the results. These tests show that there is very little significant difference between the horizontal cutting forces and the normal force for bits cutting dry but with a wet tip, when the axial water bit forces are considered it is obvious that the normal forces have been modified drastically. This leads one to conclude that the dramatic reduction in normal forces has great potential for reducing sumping forces (forces that push the drum head as a whole into the coal face), total machine weight, and power requirements. It is at ½ inch depth at which the negative value of the normal force indicates that the conical shaped bit was pulling into the coal rather than being forced in as is usually the case for cutters. The only other known type of bit that can be designed to do this is a high rake chisel bit. However, since most United States mines use conical bits for their continuous mining machines, the significance of this test result should be apparent as to the reduction in power consumption and other economies.

Other benefits are also possible with this invention. These include the reduction in the possibility of ignitions at the coal face since frictional heating is a direct result of high normal loads and unlubricated abrasion which this axial nozzle technique will control. Whatever, these added benefits may be; none should be excluded as long as they fall within the scope and spirit of the claims that follow:

I claim:

1. A method of controlling the dust generated by a rotatable head cutting machine having material cutting bits on the head comprising the steps of:

(1) providing a source of water pressurized to at least 2,000 but, less than 5,000 psi., which is conveyed through an internal bit conduit to where it is discharged no more than ⅛ of an inch from the cutting edge of the bits;

(2) controlling the discharge of said pressurized water such that it begins shortly before the bits contact the coal bearing material's crushing zone and ends after contact therewith; and (3) controlling the amount of water discharged from each of the machine's cutting bits by preselecting an orifice discharge diameter whose selection is a function of the material being cut and the discharge pressure.

2. The method of claim 1 including the further step of:

(5) sumping the cutting head with its attached bits into the material's working face at least three inches.

3. The method of claim 2 including the further step of:

(6) rotating the cutting machine's head as steps (1) and (5) are performed.

4. A method of controlling the dust generated by a rotatable head cutting machine having material cutting bits on the head comprising the steps of:

(1) providing a source of water pressurized to at least 2,000 but, less than 5,000 psi., which is conveyed through an internal bit conduit to where it is discharged at or near the cutting edge of the bits;

(2) controlling the discharge of said pressurized water such that it begins shortly before the bits contact the material's crushing zone and ends after contact therewith; and (3) controlling the amount of water discharged from each of the machine's cutting bits by preselecting an orifice discharge diameter which is about one-third the internal uniform length of the tip's conduit, this selection of diameter being a function of the material being cut and the discharge pressure.

5. A method of controlling the dust generated by a rotatable head cutting machine having material cutting bits on the head comprising the steps of:

(1) providing a source of water pressurized to at least 2,000 but, less than 5,000 psi., which is conveyed through an internal bit conduit to where it is discharged at or near the cutting edge of the bits;

(2) controlling the discharge of said pressurized water such that it begins shortly before the bits contact the material's crushing zone and ends after contact therewith; and (3) controlling the amount of water discharged from each of the machine's cutting bits by preselecting an orifice discharge diameter whose selection is a function of the material being cut and the discharge pressure; and (4) rotating the cutting bits about their own longitudinal axis as they contact the material's crushing zone.

6. A method of controlling the dust generated by a rotatable head cutting machine having material cutting bits on the head comprising the steps of:

(1) providing a source of water pressurized to at least 2,000 but, less than 5,000 psi., which is conveyed through an internal bit conduit to where it is discharged through a plurality of orifices located around and near the tip of the bit's cutting edge;

(2) controlling the discharge of said pressurized water such that it begins shortly before the bits contact the material's crushing zone and ends after contact therewith; and (3) controlling the amount of water discharged from each of the machine's cutting bits by preselecting an orifice discharge diameter whose selection is a function of the material being cut and the discharge pressure.

* * * * *